US006484919B2

(12) United States Patent
Ho

(10) Patent No.: US 6,484,919 B2
(45) Date of Patent: Nov. 26, 2002

(54) ADHESIVE TAPE CUTTING DEVICE WITH A PIVOTABLE RETAINING PLATE FOR RETAINING A TAPE ROLL

(76) Inventor: Ming-Fa Ho, 12F, No. 35, Lane 90, Ya-Chou Rd., Tu-Cheng City, Taipei Hsien (TW)

( * ) Notice: Subject to any disclaimer, the term of this patent is extended or adjusted under 35 U.S.C. 154(b) by 0 days.

(21) Appl. No.: 09/912,145

(22) Filed: Jul. 23, 2001

(65) Prior Publication Data

US 2002/0027148 A1 Mar. 7, 2002

(51) Int. Cl.[7] ..... B26F 3/02

(52) U.S. Cl. ..... 225/13; 225/39; 225/51; 225/52

(58) Field of Search ..... 225/13, 10, 12, 225/15, 39, 51, 52, 82, 85, 86, 77; 156/527

(56) References Cited

U.S. PATENT DOCUMENTS 2,589,587 A * 3/1952 Weaklend et al. ..... 225/52
2,817,404 A * 12/1957 Vogt ..... 225/51
2,825,452 A * 3/1958 Klein ..... 225/52
2,834,646 A * 5/1958 Berg ..... 225/51
2,889,975 A * 6/1959 Hanon ..... 225/39
5,073,228 A * 12/1991 Lin ..... 225/51
5,456,790 A * 10/1995 Yu Chen ..... 156/527

* cited by examiner

*Primary Examiner*—Hwei-Siu Payer
(74) *Attorney, Agent, or Firm*—Sheridan Ross P.C.

(57) ABSTRACT

An adhesive tape cutting device includes a body, a roll mounting shaft, a roller, and a tape-pressing member. The body has a small side wall and a large side wall. The roll mounting shaft is attached to the large side wall so that an adhesive tape roll can be sleeved on the shaft. The tape-pressing member is biased to press a free end portion of a tape on the tape roll against the roller, and is attached to a retaining plate, which is hinged to the large side wall and which is locked on the small side wall so as to confine the tape roll between the retaining plate and the large side wall. The retaining plate can be unlocked from the small side wall so as to move to an open position, where the tape roll can be removed from the roll mounting shaft.

9 Claims, 5 Drawing Sheets

ADHESIVE TAPE CUTTING DEVICE WITH A PIVOTABLE RETAINING PLATE FOR RETAINING A TAPE ROLL

BACKGROUND OF THE INVENTION

1. Field of the Invention

This invention relates to an adhesive tape cutting device, more particularly to an adhesive tape cutting device, which includes a retaining plate that is pivotable on a body between a closed position, where the retaining plate can be locked on the body so as to retain an adhesive tape roll on the body, and an open position, where the tape roll can be removed from the body.

2. Description of the Related Art

The improvement of this invention is directed to a conventional adhesive tape cutting device, which includes a body, a roll mounting shaft, a cutting blade, a roller, and a spring-loaded tape-pressing plate. The body has a large side wall, a small side wall that is parallel to the large side wall, and a connecting wall that interconnects the large and small side walls. The roll mounting shaft is attached to the large side wall so that an adhesive tape roll can be sleeved on the shaft. The cutting blade is fixed to the connecting wall. The roller is disposed rotatably between the large and small side walls. The tape-pressing plate is biased to press a free end portion of a tape on the tape roll against the roller, thereby facilitating applying and cutting of the tape. The aforesaid conventional adhesive tape cutting device has the following disadvantages:

(1) The adhesive tape roll is not retained on the shaft, thereby resulting in unintentional removal of the former from the latter.

(2) Because the tape-pressing plate always presses against the roller, it is difficult to insert the free end portion of the tape between the roller and the tape-pressing plate.

SUMMARY OF THE INVENTION

An object of this invention is to provide an adhesive tape cutting device with a retaining plate that can retain an adhesive tape roll on a body of the device.

Another object of this invention is to provide an adhesive tape cutting device with a tape-pressing member that can be removed from a roller so as to permit insertion of a free end portion of an adhesive tape between the roller and the tape-pressing member.

According to this invention, an adhesive tape cutting device includes a body, a roll mounting shaft, a roller, and a tape-pressing member. The body has a small side wall and a large side wall. The roll mounting shaft is attached to the large side wall so that an adhesive tape roll is sleeved on the roll mounting shaft. The tape-pressing member is biased to press a free end portion of a tape on the tape roll against the roller, and is attached to a retaining plate, which is hinged to the large side wall and which is locked on the small side wall so as to confine the tape roll between the retaining plate and the large side wall. The retaining plate can be unlocked from the small side wall so as to move to an open position, where the tape roll can be removed from the roll mounting shaft. As such, when the retaining plate is disposed at the open position, the tape-pressing member is spaced apart from the roller, thereby permitting insertion of the free end portion of the tape between the roller and the tape-pressing member.

BRIEF DESCRIPTION OF THE DRAWINGS

These and other features and advantages of this invention will become apparent in the following detailed description of the preferred embodiments of this invention with reference to the accompanying drawings, in which.

DETAILED DESCRIPTION OF THE PREFERRED EMBODIMENTS

Figure 1:
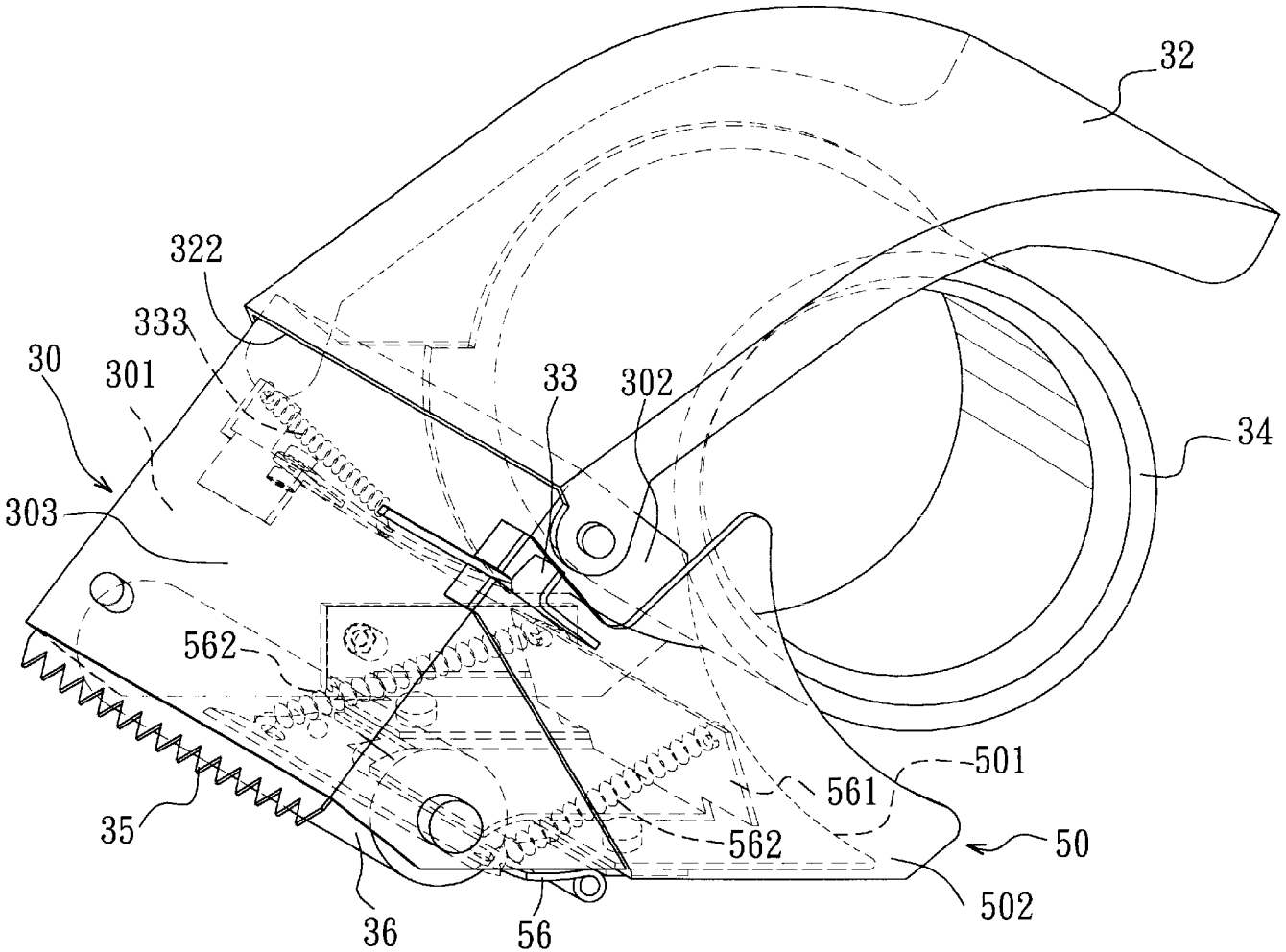
FIG. 1 is an assembled perspective view of a first preferred embodiment of an adhesive tape cutting device according to this invention.
Figure 2:
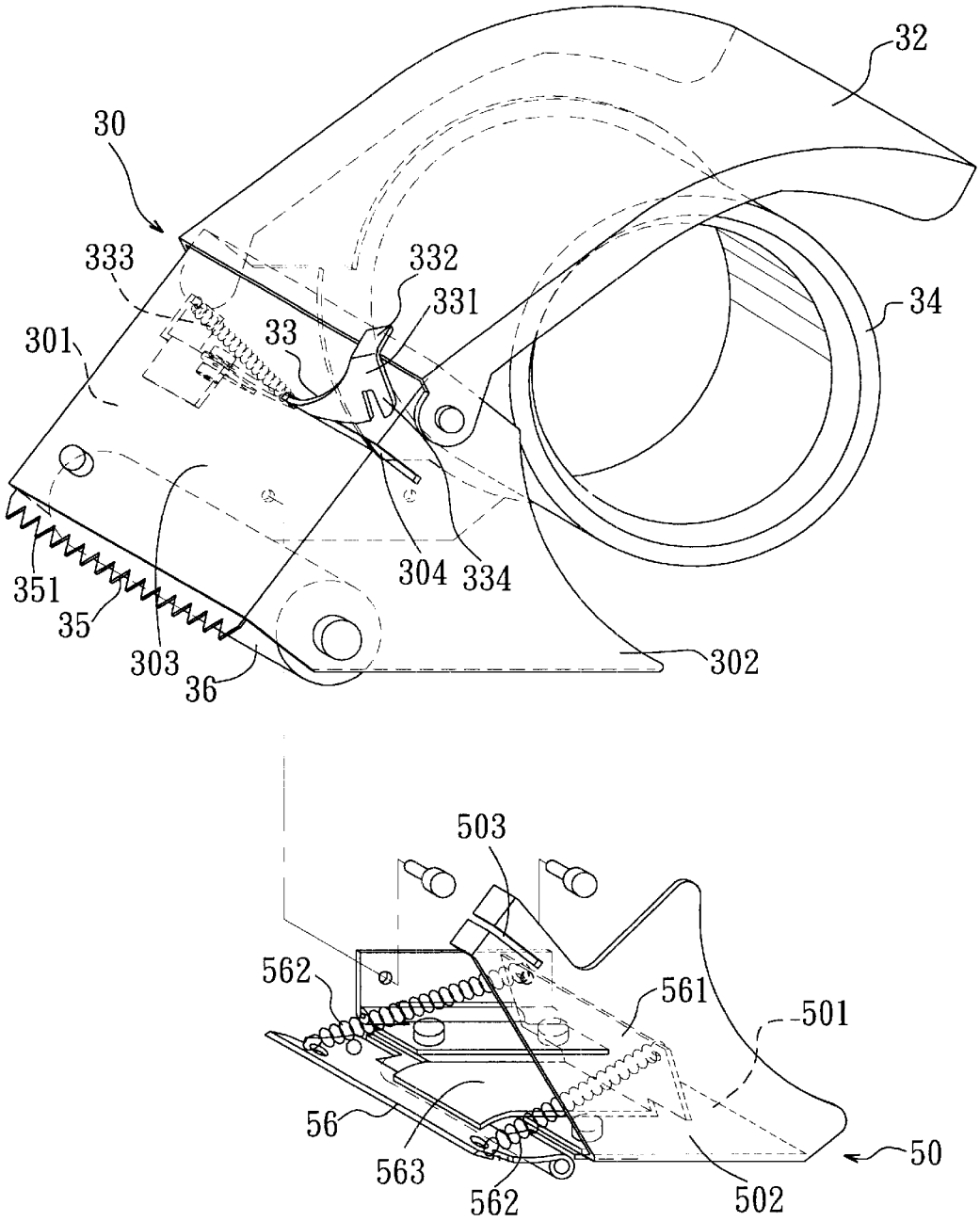
FIG. 2 is a partly exploded perspective view of the first preferred embodiment.
Figure 3:
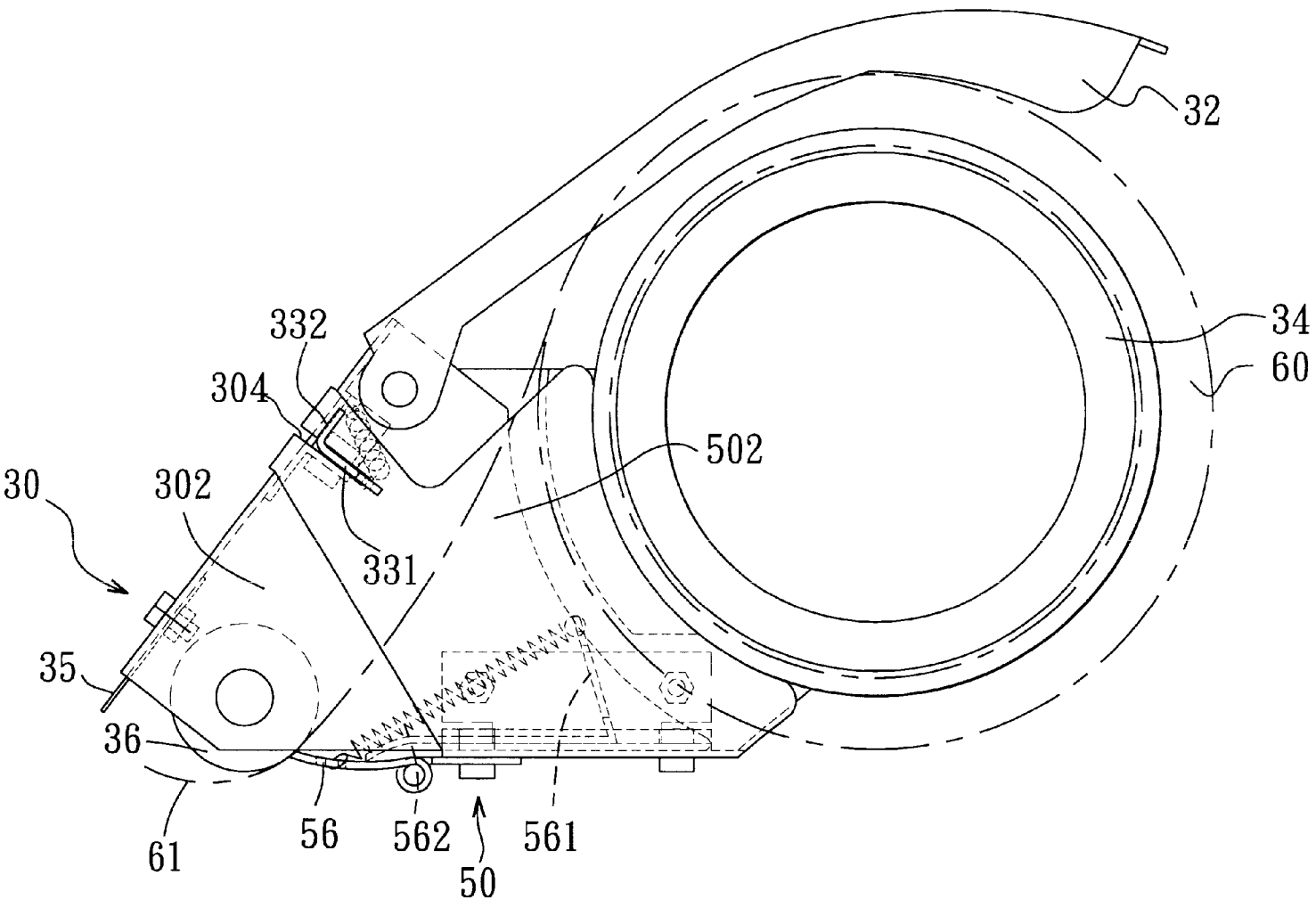
FIG. 3 is a side view of the first preferred embodiment when a retaining plate thereof is disposed at a closed position.
Figure 4:
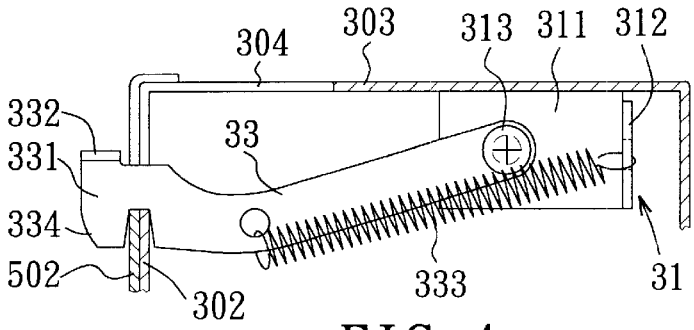
FIG. 4 is a sectional view, illustrating how a lock lever is mounted on a body of the first preferred embodiment.

Referring to FIGS. 1, 2, 3 and 4, a first preferred embodiment of an adhesive tape cutting device according to this invention is shown to include a body 30 and a retaining plate 50. The body 30 has a large side wall 301, a small side wall 302, and a connecting wall 303. The large side wall 301 has a front portion and a rear portion, which is formed integrally with a roll mounting shaft 34 that extends perpendicular thereto and that is adapted to mount an adhesive tape roll 60 (as shown in phantom lines in FIG. 3) rotatably therearound. The small side wall 302 is parallel to the large side wall 301. The connecting wall 303 has two opposite sides which are formed respectively and integrally with and which are perpendicular to the large and small side walls 301, 302. A handle plate 32 has a front end that is mounted pivotally on a rear end of the connecting wall 303, a rear end that is adapted to cover a portion of the tape roll 60, and a front abutment edge 322 that is formed at the front end of the handle plate 32 and that is rotatable away from the roll mounting shaft 34 so as to contact the connecting wall 303, thereby preventing further rotation of the handle plate 32 away from the roll mounting shaft 34. A cutting blade 35 is disposed fixedly on a front end of the connecting wall 303, and has a curved row of sawteeth 351. A roller 36 is disposed rotatably among the front end of the connecting wall 303, and the large and small side walls 302, and is disposed adjacent to the cutting blade 35 and parallel to the shaft 34.

The retaining plate 50 is mounted pivotally on the large side wall 301, and has a pivot plate portion 501 and a blocking plate portion 502 that is formed with an open-ended slot 503. The pivot plate portion 501 and the blocking plate portion 502 are perpendicular to each other. The pivot plate portion 501 is inclined relative to the connecting wall 303, and has a first side that is hinged to the large side wall 301, and a second side that is opposite to the first side and that is formed integrally with the blocking plate portion 502. When the blocking plate portion 502 is disposed at a closed position, it abuts against the small side wall 302 so as to confine the tape roll 60 between the large side wall 301 and the blocking plate portion 502.

Figure 5:
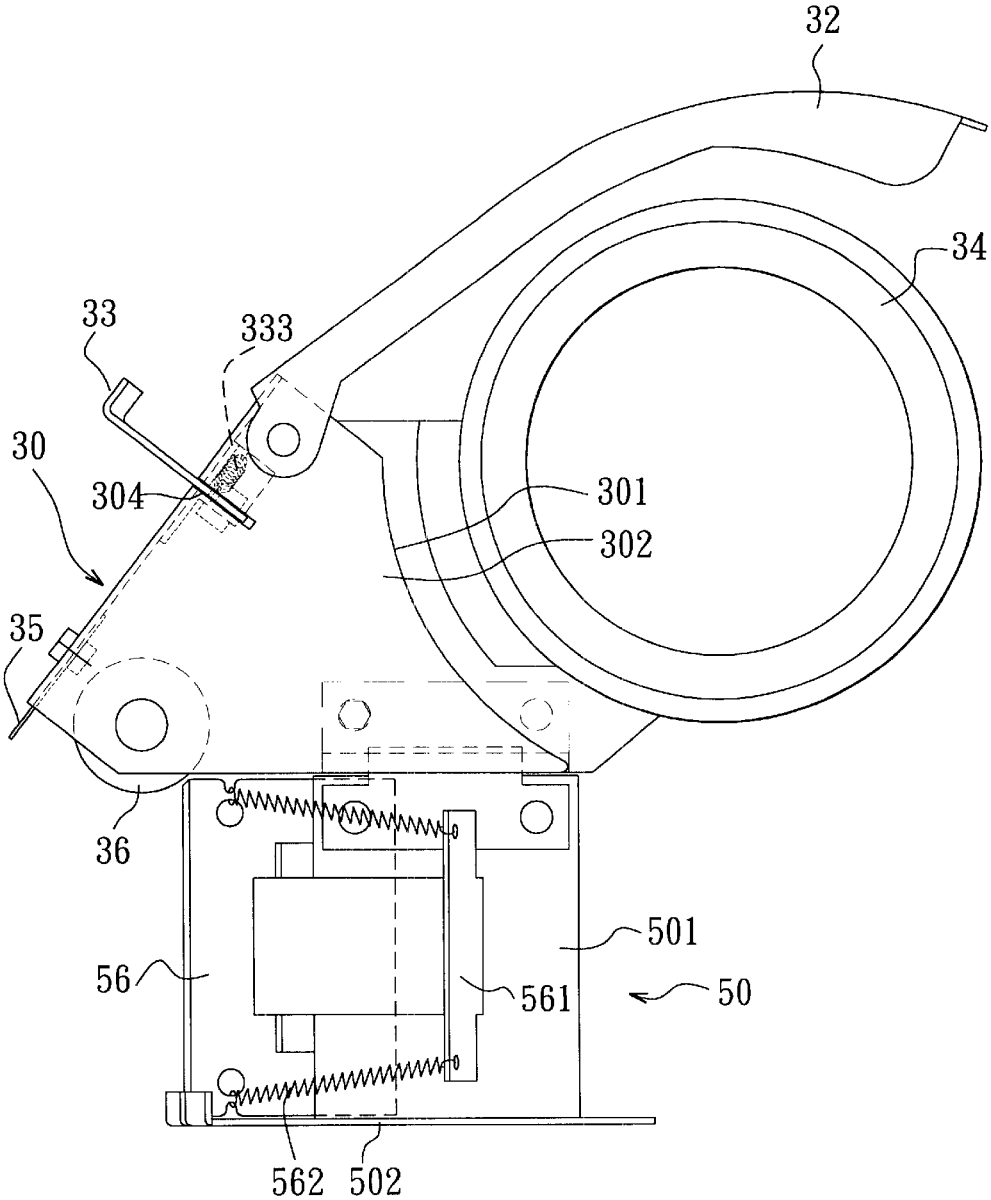
FIG. 5 is a side view of the first preferred embodiment when the retaining plate is disposed at an open position.

The body 30 has an L-shaped slot 304 that is aligned with the slot 503 in the blocking plate portion 502 of the retaining plate 50, and has two straight slot portions that are formed respectively in the connecting wall 303 and the small side wall 302 and that are communicated with each other. An L-cross-sectioned mounting plate 31 (see FIG. 4) is fixed to an inner surface of the connecting wall 303, and has a large plate portion 311, on which an end of a locking lever 33 is mounted pivotally by means of a pivot pin 313, and a small plate portion 312 that is perpendicular to the large plate portion 311. The locking lever 33 extends through the L-shaped slot 304 in the body 30 and the slot 503 in the blocking plate portion 502 of the retaining plate 50. A free end of the locking lever 33 is formed with a U-shaped insert plate 331 and an actuator plate 332, which are perpendicular to each other. The insert plate 331 is generally perpendicular to the connecting wall 303 and the small side wall 302, and is inserted into the slot 503 in the blocking plate portion 502 of the retaining plate 50. The actuator plate 332 extends integrally from the insert plate 331, and is generally parallel to the connecting wall 303. Accordingly, the actuator plate 332 can be held between a thumb and an index finger on one hand of the user during rotation of the locking lever 33. A coiled tension spring 333 interconnects an intermediate portion of the locking lever 33 and the small plate portion 312 so as to bias a locking portion 334 of the locking lever 33 to abut against an outer surface of the blocking plate portion 502 of the retaining plate 50, thereby locking the blocking plate portion 502 of the retaining plate 50 on the small side wall 302. The locking lever 33 can rotate in a direction against the biasing action of the spring 333 so as to disengage from the slot 503 in the blocking plate portion 502, thereby permitting rotation of the blocking plate portion 502 away from the roller 36 and the roll mounting shaft 34 to an open position shown in FIG. 5, where the tape roll 60 can be removed from the roll mounting shaft 34.

The pivot plate portion 501 of the retaining plate 50 includes a tape-pressing member 56 that is made of a rigid material, a mounting sheet 561 and two coiled tension springs 562. The mounting sheet 561 is fixed to and is inclined relative to an inner surface of the pivot plate portion 501 so as to define a space 563 (see FIG. 2) between the mounting sheet 561 and the tape-pressing member 56. The tension springs 562 interconnect the tape-pressing member 56 and the mounting sheet 561 so as to press a free end portion 61 (see FIG. 3) of the tape 60 (see FIG. 3) against the roller 36, thereby retaining the free end portion 61 of the tape 60 between the tape-pressing member 56 and the roller 36. The biasing force of the springs 562 is relatively small so that the free end portion 61 of the tape 60 can be pulled forwardly, thereby moving between the roller 36 and the pressing member 56. As such, in case the free end portion 61 of the tape 60 is stuck on the tape-pressing member 56 such that it is difficult to move the tape 60 between the tape-pressing member 56 and the roller 36, the blocking plate portion 502 of the retaining plate 50 can be rotated to the open position shown in FIG. 5 in order to permit one finger of the user to be inserted into the space 563 between the mounting sheet 561 and the tape-pressing member 56, thereby removing the free end portion 61 of the adhesive tape 60 from the roller 36.

Figure 6:
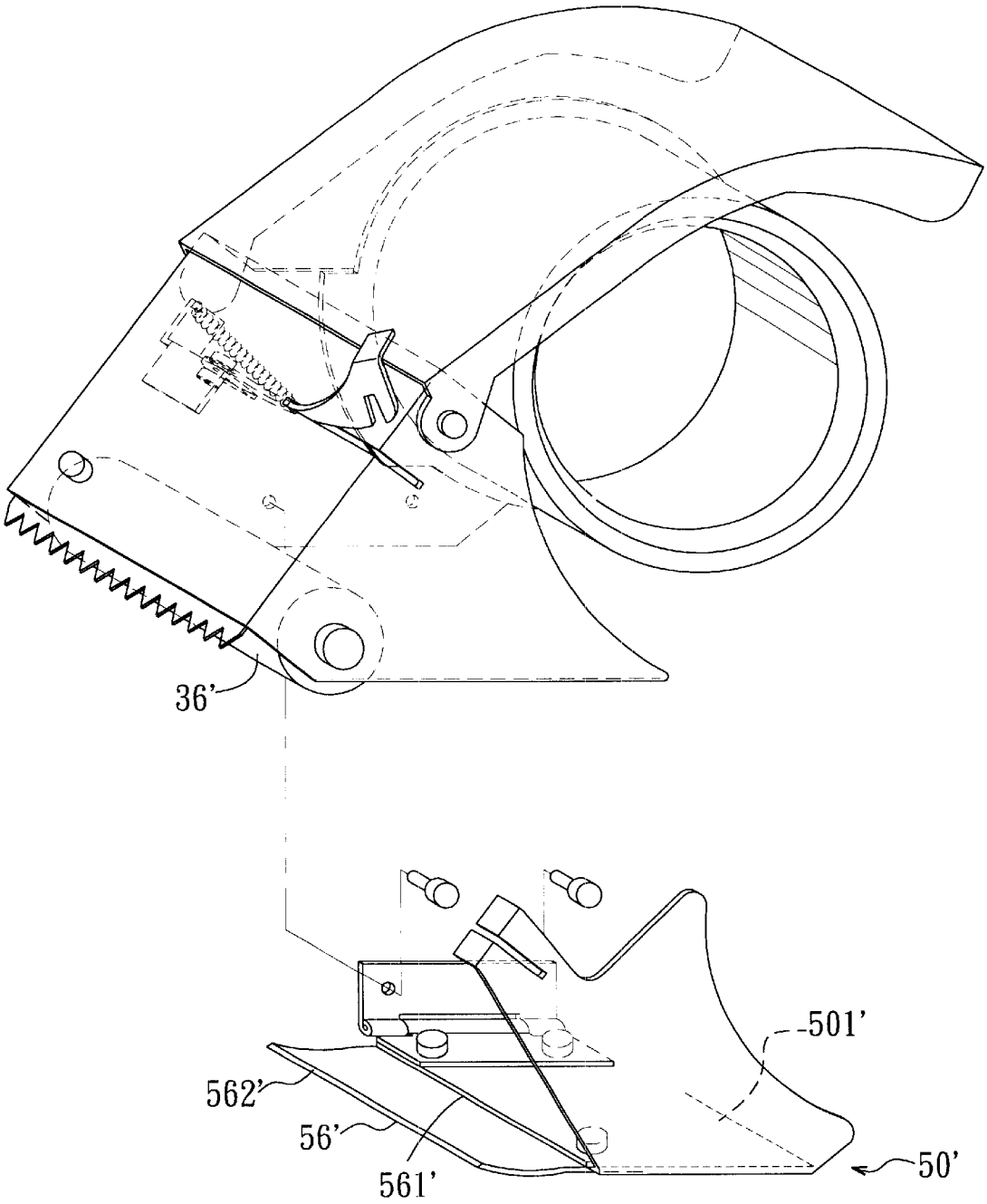
FIG. 6 is a partly exploded perspective view of a second preferred embodiment of an adhesive tape cutting device according to this invention.

FIG. 6 shows another preferred embodiment of this invention, which is similar to the previous embodiment in construction. Unlike the previous embodiment, the tape-pressing member 56' is made of plastic, and has a first side 561' that is fastened to the pivot plate portion 501' of the retaining plate 50', and a second side 562' that presses against the roller 36'. In this embodiment, it is not necessary to mount the mounting sheet 561 (see FIG. 2) and the tension springs 562 (see FIG. 2) on the pivot plate portion 501' of the retaining plate 50'.

The adhesive tape cutting device of this invention has the following advantages:

(1) The blocking plate portion 502 of the retaining plate 50, 50' and the large side wall 301 of the body 30 confine cooperatively the tape roll 60 therebetween, thereby preventing unintentional removal of the tape roll 60 from the roll mounting shaft 34.

(2) When it is desired to mount the tape roll 60 on the roll mounting shaft 34, the blocking plate portion 502 of the retaining plate 50, 50' can be rotated to the open position so as to mount the tape roll 60 on the roll mounting shaft 34. At this time, because the tape-pressing member 56, 56' is spaced apart from the roller 36, 36', the free end portion 61 of the tape 60 can be inserted easily between the roller 36, 36' and the tape-pressing member 56, 56'.

(3) In case the free end portion 61 of the tape 60 is stuck on the tape-pressing member 56, 56' such that it cannot move between the roller 36, 36' and the tape-pressing member 56, 56', the blocking plate portion 501, 501' of the retaining plate 50, 50' can be rotated to the open position so as to remove the free end portion 61 of the tape 60 from the tape-pressing member 56, 56'.

(4) The handle plate 32 can be held, thereby making it convenient to performing tape applying and cutting operations.

(5) The sawteeth 351 of the cutting blade 35 are arranged in a curved row, thereby facilitating cutting of the tape 60.

With this invention thus explained, it is apparent that numerous modifications and variations can be made without departing from the scope and spirit of this invention. It is therefore intended that this invention be limited only as indicated by the appended claims.

I claim:

1. An adhesive tape cutting device comprising:

a body including a large side wall having a front portion and a rear portion, which is formed with a roll mounting shaft that extends perpendicular thereto and that is adapted to mount an adhesive tape roll therearound, a small side wall parallel to said large side wall, and a connecting wall having a front end, a rear end, and two opposite sides that are formed respectively and integrally with and that are perpendicular to said large and small side walls;

a cutting blade disposed fixedly on said front end of said connecting wall;

a roller disposed rotatably among said front end of said connecting wall, said large side wall and said small side wall , and disposed adjacent to said cutting blade and parallel to said roll mounting shaft;

a retaining plate mounted pivotally on said large side wall and having a blocking plate portion that is locked releaseably on said small side wall so as to be adapted to confine the tape roll between said blocking plate portion of said retaining plate and said large side wall, said blocking plate portion of said retaining plate having an outer surface and being rotatable away from said roller and said roll mounting shaft to an open position when unlocked from said small side wall, thereby permitting removal of the tape roll from said roll mounting shaft; and a tape-pressing member disposed pivotally on said retaining plate and adapted to be biased to press a free end portion of a tape on the tape roll against said roller, thereby retaining the free end portion of the tape between said tape-pressing member and said roller, said tape-pressing member being removed from said roller when said blocking plate portion of said retaining plate is moved to said open position;

whereby, the free end portion of the tape can be pulled forwardly so as to move between said roller and said tape-pressing member.

2. The adhesive tape cutting device as claimed in claim 1, further comprising a handle plate, which has a front end that is mounted pivotally on said rear end of said connecting wall, a rear end that is adapted to cover a portion of the tape roll, and a front abutment edge that is formed at said front end of said handle plate and that is rotatable away from said roll mounting shaft so as to contact said connecting wall, thereby preventing further rotation of said handle plate away from said roll mounting shaft.

3. The adhesive tape cutting device as claimed in claim 1, wherein said blocking plate portion of said retaining plate abuts against said small side wall, said retaining plate further including a pivot plate portion which is inclined relative to said connecting wall and which is perpendicular to said blocking plate portion, said pivot plate portion having a first side that is hinged to said large side wall, and a second side that is opposite to said first side and that is formed integrally with said blocking plate portion.

4. The adhesive tape cutting device as claimed in claim 3, wherein said blocking plate portion of said retaining plate is formed with an open-ended slot, said adhesive tape cutting device further including:

an L-shaped slot aligned with said slot in said blocking plate portion of said retaining plate and having two straight slot portions that are formed respectively in said connecting wall and said small side wall and that are communicated with each other; and a spring-loaded locking lever disposed pivotally on said connecting wall and extending through said L-shaped slot in said body and said slot in said blocking plate portion of said retaining plate, said locking lever having a locking portion that is biased to abut against said outer surface of said blocking plate portion of said retaining plate so as to lock said blocking plate portion on said small side wall, said locking lever being rotatable relative to said body so as to disengage from said slot in said blocking plate portion, thereby permitting rotation of said blocking plate portion to said open position.

5. The adhesive tape cutting device as claimed in claim 4, wherein said locking lever has a free end, which is formed with:

a U-shaped insert plate extending perpendicular to said connecting wall and said small side wall and inserted into said slot in said blocking plate portion of said retaining plate; and an actuator plate formed integrally with said insert plate and extending generally perpendicular to said insert plate and generally parallel to said connecting wall;

whereby, said actuator plate can be held between a thumb and an index finger on one hand of the user during rotation of said locking lever.

6. The adhesive tape cutting device as claimed in claim 4, wherein said connecting wall has:

an inner surface;

an L-cross-sectioned mounting plate fixed to said inner surface of said connecting wall and having a large plate portion, on which an end of said locking lever is mounted pivotally, and a small plate portion that is perpendicular to said large plate portion; and a coiled tension spring interconnecting an intermediate portion of said locking lever and said small plate portion so as to bias said locking portion of said locking lever to abut against said outer surface of said blocking plate portion of said retaining plate, thereby locking said blocking plate portion of said retaining plate on said small side wall.

7. The adhesive tape cutting device as claimed in claim 3, wherein said tape-pressing member is made of a rigid material, said pivot plate portion of said retaining plate having an inner surface, a mounting sheet that is fixed to and that is inclined relative to said inner surface of said pivot plate portion so as to define a space between said mounting sheet and said tape-pressing member, and two tension springs that interconnect said tape-pressing member and said mounting sheet so as to be adapted to press the free end portion of the adhesive tape against said roller, whereby, when said blocking plate portion of said retaining plate is rotated to said open position, one finger of the user can be inserted into the space between said mounting sheet and said tape-pressing member so as to remove the free end portion of the tape from said roller.

8. The adhesive tape cutting device as claimed in claim 1, wherein said tape-pressing member is made of plastic, and has a first side that is fastened to said pivot plate portion of said retaining plate, and a second side that is adapted to press the free end portion of the adhesive tape against said roller.

9. The adhesive tape cutting device as claimed in claim 1, wherein said cutting blade includes a curved row of sawteeth to facilitate cutting of the tape.

* * * * *